US011052421B2

(12) United States Patent
Li et al.

(10) Patent No.: US 11,052,421 B2
(45) Date of Patent: Jul. 6, 2021

(54) GLUE-SAVING MECHANISM, GLUE GUN HANDLE, GLUE GUN AND USE METHOD THEREOF

(71) Applicant: TIANJIN JINMAO GROUP CO., LTD, Tianjin (CN)

(72) Inventors: Jie Li, Tianjin (CN); Qi Zhu, Tianjin (CN); Shengjiang Wang, Tianjin (CN)

(73) Assignee: TIANJIN JINMAO GROUP CO., LTD, Tianjin (CN)

( * ) Notice: Subject to any disclaimer, the term of this patent is extended or adjusted under 35 U.S.C. 154(b) by 0 days.

(21) Appl. No.: 16/627,454

(22) PCT Filed: Sep. 16, 2019

(86) PCT No.: PCT/CN2019/105941
§ 371 (c)(1),
(2) Date: Dec. 30, 2019

(87) PCT Pub. No.: WO2021/027003
PCT Pub. Date: Feb. 18, 2021

(65) Prior Publication Data

US 2021/0046503 A1 Feb. 18, 2021

(51) Int. Cl.
*B05C 17/01* (2006.01)

(52) U.S. Cl.
CPC ..... *B05C 17/01* (2013.01)

(58) Field of Classification Search
CPC .... B05C 17/01; B05C 17/014; B05C 17/0123
See application file for complete search history.

(56) References Cited

U.S. PATENT DOCUMENTS 6,766,923 B1 * 7/2004 Huang ..... B05C 17/01 222/327
2008/0149216 A1 * 6/2008 Speck ..... B65B 31/003 141/3

(Continued)

FOREIGN PATENT DOCUMENTS

JP 2004100392 A * 4/2004 ..... B05C 17/01

*Primary Examiner* — Vishal Pancholi
*Assistant Examiner* — Bob Zadeh
(74) *Attorney, Agent, or Firm* — Casimir Jones, S.C.; Tanya A. Arenson

(57) ABSTRACT

The present disclosure provides a glue-saving mechanism, a glue gun handle, a glue gun and a use method thereof, and relates to the technical field of gluing tools, wherein the glue-saving mechanism is applicable to the glue gun and includes a body and a locking piece; a top end of the locking piece is connected with a rear end of the body, the locking piece is provided with a assembling hole for glue gun ejector rod penetrating the locking piece, and the angle between a front surface of the locking piece and the horizontal direction is greater than 0° and smaller than 90° when a length extension direction of a glue gun ejector rod in a working condition that the glue gun ejector rod is assembled to the glue gun is regarded as a horizontal direction; a guiding structure is provided on the body, and the guiding structure is used for guiding the body to slide forward and backward relative to a glue gun handle in a working condition that the glue-saving mechanism is assembled at a top end of the glue gun handle; and the glue gun handle is mounted with the glue-saving mechanism, and the glue gun has the glue gun handle. The present disclosure has the advantageous effect of controlling the glue to stop outflowing when the glue gun stops gluing so as to save glue.

19 Claims, 6 Drawing Sheets

(56) References Cited

U.S. PATENT DOCUMENTS

2011/0056994 A1* 3/2011 Yen ..... B05C 17/0126
222/326
2019/0299244 A1* 10/2019 Xia ..... B05C 17/0052

* cited by examiner

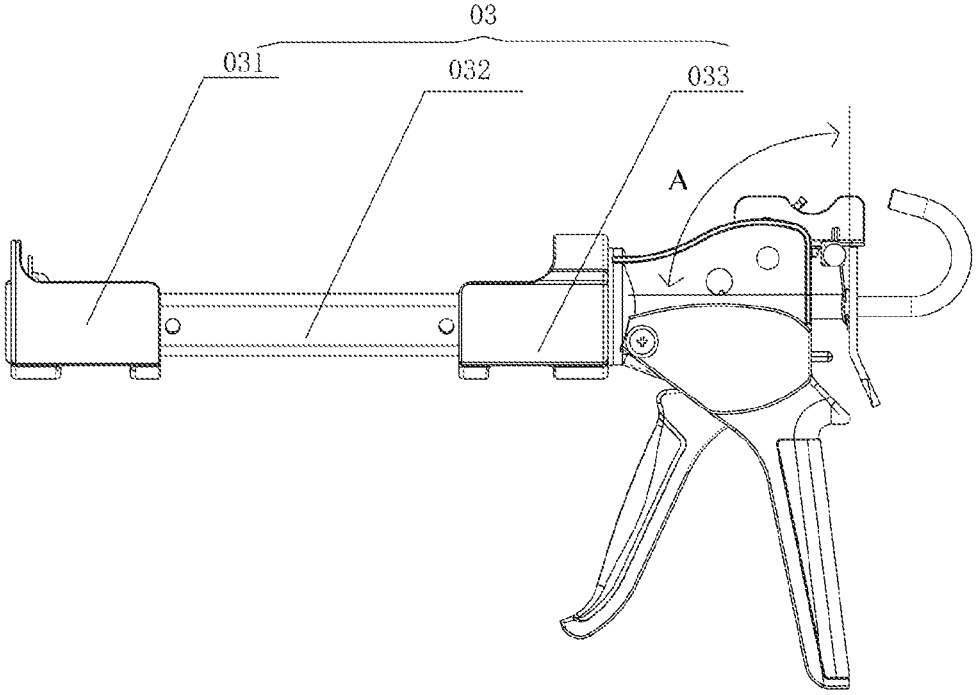
FIG. 9
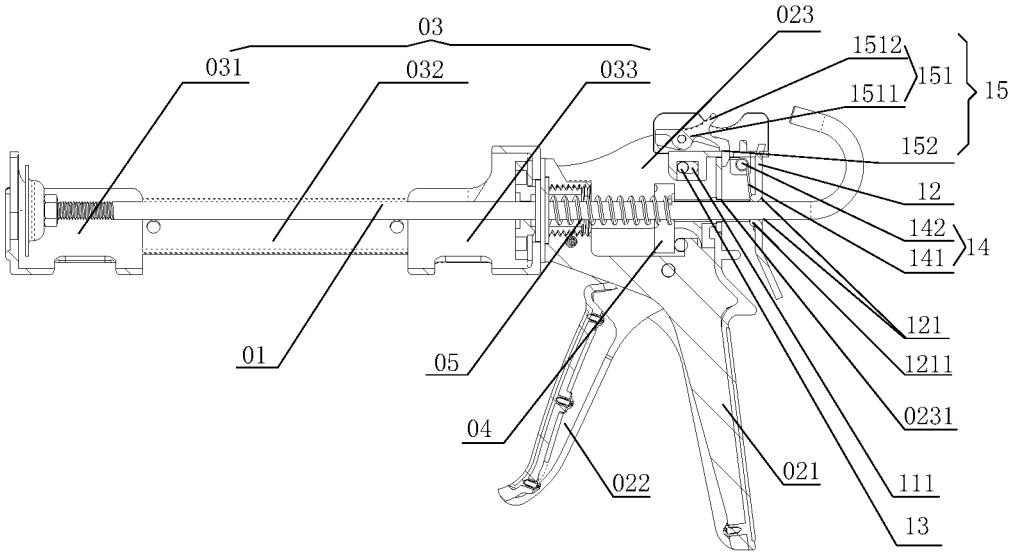

GLUE-SAVING MECHANISM, GLUE GUN HANDLE, GLUE GUN AND USE METHOD THEREOF

CROSS-REFERENCE TO RELATED APPLICATIONS

The present disclosure claims priority of Chinese Patent Application No. 201910738756.9, filed with the Chinese Patent Office on Aug. 12, 2019 and entitled "Glue-saving Mechanism, Glue Gun Handle and Glue Gun", the contents of which are incorporated herein by reference in their entirety.

TECHNICAL FIELD

The present disclosure relates to gluing tools, and particularly to a glue-saving mechanism, a glue gun handle, a glue gun and a use method thereof.

BACKGROUND ART

In the prior art, when a glue gun stops gluing, there occurs a phenomenon that glue in the glue cartridge partially continues flowing out from the glue outlet of the glue cartridge under the action of an internal pressure of the glue cartridge. In actual use, although in some cases such phenomenon that the glue continues flowing out from the glue cartridge after the gluing stops does not affect the use, and this phenomenon even brings certain advantages in a work requiring continuous glue discharge, in some cases, the phenomenon that the glue continues flowing out from the glue cartridge after the gluing stops interferes with the process, and also leads to a problem of serious waste of glue.

SUMMARY

Objects of the present disclosure include providing a glue-saving mechanism, a glue gun handle, a glue gun and a use method thereof, so as to alleviate the technical problem in the prior art that when a glue gun stops gluing, the glue in the glue cartridge continues flowing out from the glue outlet of the glue cartridge under the action of the internal pressure of the glue cartridge, which bring the advantageous effect glue-saving by controlling the glue to stop flowing when the glue gun stops gluing.

An embodiment of the present disclosure provides a glue-saving mechanism, which is applicable to a glue gun, comprising a body and a locking piece; wherein a top end of the locking piece is connected with a rear end of the body, the locking piece is provided with a assembling hole for glue gun ejector rod which penetrates the locking piece, and an angle between a front surface of the locking piece and the horizontal direction is greater than 0° and smaller than 90° when a length extension direction of a glue gun ejector rod in a working condition that the glue gun ejector rod is assembled to the glue gun is regarded as a horizontal direction; and a guiding structure is provided on the body, and the guiding structure is configured to guide the body to slide forward and backward relative to a glue gun handle in a working condition that the glue-saving mechanism is assembled at a top end of the glue gun handle.

Optionally, the top end of the locking piece is movably connected with the rear end of the body, and a locking assembly is mounted between the body and the locking piece; and the locking assembly is configured so that the angle between the front surface of the locking piece and the horizontal direction is greater than 0° and smaller than 90°.

Optionally, a bottom surface of the rear end of the body is provided with a mounting hole, and the top end of the locking piece is movably inserted into the mounting hole.

In an optional implementation mode, the locking assembly comprises an elastic energy storage member;

wherein one end of the elastic energy storage member is fixed to the body, and the other end of the elastic energy storage member abuts the locking piece and is configured so that the locking piece always has a movement tendency enabling the angle between the front surface of the locking piece and the horizontal direction to be greater than 0° and smaller than 90°.

Optionally, the locking assembly further comprises a mounting shaft, the mounting shaft is fixed to a bottom of the body; and the elastic energy storage member comprises a U-shaped spring, wherein both ends of the U-shaped spring keep away from the mounting shaft and abut a bottom surface of the body, and a U-shaped end of the U-shaped spring abuts the locking piece.

Optionally, one side of the assembling hole for glue gun ejector rod facing the U-shaped spring is flanged to form a flange, and the U-shaped end of the U-shaped spring is sleeved outside the flange.

Optionally, the elastic energy storage member comprises a torsion spring or a magnetic attraction structure, the bottom of the body is provided with a fixing hole, one end of the torsion spring or the magnetic attraction structure is fixed in the fixing hole, and the other end of the torsion spring or the magnetic attraction structure abuts the locking piece.

Optionally, the guiding structure comprises a long limiting hole; wherein the long limiting hole penetrates a side wall of the body, and a center line of the long limiting hole extends in the horizontal direction; and the glue-saving mechanism further comprises a limiting member, wherein the limiting member is slidably disposed inside the long limiting hole, and an end portion of the limiting member passes through the long limiting hole to be fixed to the top end of the glue gun handle.

Optionally, the glue-saving mechanism further comprises a switching button;

the bottom surface of the body is provided with a switching limiting hole;

wherein the switching button comprises a button body and a limiting portion connected with each other, and the button body is pivotally connected with the body and is configured to drive the limiting portion into or away from the switching limiting hole; and in a working condition that the glue-saving mechanism is assembled to the top end of the glue gun handle and the limiting portion is in the switching limiting hole, the limiting portion abuts a rear end surface of the glue gun handle, and the limiting member is positioned at the frontmost end of the long limiting hole.

Optionally, the button body comprises a connecting portion and a rotating portion; and wherein one end of the connecting portion is pivotally connected with the body; one end of the rotating portion is connected with the top of the connecting portion, and the other end of the rotating portion extends obliquely upward; and one end of the limiting portion is connected with the other end of the connecting portion, and the other end of the limiting portion extends downward.

An embodiment of the present disclosure provides a glue gun handle, comprising a fixed handle, a movable handle and a top connector, wherein the top connector is provided with a penetrating hole configured for allowing the glue gun ejector rod to pass therethrough; an upper end of the fixed handle is fixedly connected with a lower end of the top connector; an upper end of the movable handle is pivotally connected with the interior of the top connector, and the movable handle is at a front side of the fixed handle; and the glue gun handle further comprises the above-described glue-saving mechanism; and a top end of the top connector is provided with a groove extending in the horizontal direction and having a rear end penetrating the top connector; the body is mounted inside the groove so as to be slidable forward and backward relative to the top connector, and the rear end of the body protrudes from the groove; and the locking piece is at the rear side of the top connector.

An embodiment of the present disclosure provides a glue gun, comprising a gun body and the above-described glue gun handle;

Wherein the gun body comprises a front connector, a middle connector and a rear connector which are sequentially connected;

the front connector and the rear connector are both cylindrical, a top, a front end and a rear end of the front connector are open, a front end of the rear connector is open, and a rear end of the rear connector is connected with the front end of the glue gun handle; and the front connector and the rear connector are both made of plastic, and the middle connector is made of metal.

Optionally, the middle connector is made of an aluminum material, and an outer side of the middle connector is coated with an oxidation-resistant coating.

An embodiment of the present disclosure further provides a use method using the above-described glue gun, comprising use steps of:

placing the glue cartridge into the gun body with a glue outlet thereof facing forwards;

passing the glue gun ejector rod sequentially through the mounting hole and the assembling hole for glue gun ejector rod, with the front end of the glue gun ejector rod abutting the glue cartridge; and pulling the movable handle to make the glue gun ejector rod and the glue-saving mechanism synchronously move forward along the groove until the locking piece is stuck on the rear end surface of the top connector; and continuing to pull the movable handle, with the glue-saving mechanism being kept stationary, and the glue gun ejector rod pressing the glue cartridge forward to make the glue cartridge release glue.

Optionally, when glue flows out discontinuously in a process, after the glue cartridge and the glue gun ejector rod are mounted, the button body is pulled to separate the limiting portion from the switching limiting hole; and after the glue flows out from the glue cartridge, the internal pressure of the glue cartridge drives the glue gun ejector rod and the glue-saving mechanism to move backwards along the groove, and the internal pressure of the glue cartridge decreases.

Optionally, when glue flows out continuously in a process, after the glue cartridge and the glue gun ejector rod are mounted, the button body is pulled to make the limiting portion enter the switching limiting hole; and after the glue flows out from the glue cartridge, the glue-saving mechanism is limited by the limiting portion and the limiting member and is kept stationary, and the glue in the glue cartridge flows out from the glue outlet under the internal pressure of the glue cartridge.

The embodiments of the present disclosure bring at least the following advantageous effects:

An embodiment of the present disclosure provides a glue-saving mechanism, which is applicable to a glue gun, comprising a body and a locking piece; wherein a top end of the locking piece is connected with a rear end of the body, the locking piece is provided with a assembling hole for glue gun ejector rod which penetrates the locking piece, and the angle between a front surface of the locking piece and the horizontal direction is greater than 0° and smaller than 90° when a length extension direction of a glue gun ejector rod in a working condition that the glue gun ejector rod is assembled to the glue gun is regarded as a horizontal direction; and a guiding structure is provided on the body, and the guiding structure is configured to guide the body to slide forward and backward relative to a glue gun handle in a working condition that the glue-saving mechanism is assembled at a top end of the glue gun handle.

Before use, the glue-saving mechanism is mounted at the top end of the glue gun handle first, and the specific mounting process is as follows: mounting the body at the top end of the glue gun handle so as to be slidable forward and backward along the top of the glue gun handle, positioning the locking piece at the rear side of the handle, and making the rear end of the glue gun ejector rod pass through the glue gun handle and then continue to pass through the assembling hole for glue gun ejector rod on the locking piece, wherein at this time, since the angle between the front surface of the locking piece and the horizontal direction is greater than 0° and smaller than 90°, the locking piece is inclined from the vertical direction, and the hole wall of the assembling hole for glue gun ejector rod is inclined, then the glue gun ejector rod is locked in the assembling hole for glue gun ejector rod.

At the time of operating the glue gun to release glue, the movable handle is pulled, since the glue gun ejector rod is locked in the assembling hole for glue gun ejector rod, the top end of the locking piece is connected with the rear end of the body, and the body can slide forward and backward along the top of the glue gun handle, each time the movable handle is pulled, the glue gun ejector rod and the body synchronously move forward for a certain distance, until the locking piece is stuck on the rear end surface of the top connector, or until locking piece is blocked on the rear end surface of the top connector by other blocking portions provided on the body or on the rear end surface of the top connector that can block the body from continuing to move forward, and in such case, the body immediately stops moving forward, and the glue gun ejector rod continues to move forward for a certain distance alone under the action of the movable handle and the driving block, to press the glue cartridge mounted inside the gun body of the glue gun, so as to make the glue cartridge release glue.

At the time of stopping pulling the movable handle, since the volume of the glue cartridge is reduced due to being pressed before stopping pulling the movable handle, the pressure in the cartridge is greater than the pressure outside the cartridge, and the glue cartridge has a movement tendency of slowly backward releasing the internal pressure, since the body can slide forward and backward along the top of the glue gun handle, the body can drive the glue gun ejector rod to move backward for a certain distance, at this time, the distance by which the body drives the glue gun ejector rod to move backward is equal to the aforementioned distance by which the glue gun ejector rod and the body move forward synchronously, so that the internal pressure of the glue cartridge is released slowly, which further reduces or even avoids the case where the glue in the glue cartridge continues to flow out from the glue outlet of the glue cartridge under the action of the internal pressure of the glue cartridge, so as to save glue and also reduce or even avoid continuous glue outflow which interferes with the effect of the process.

An embodiment of the present disclosure provides a glue gun handle, comprising a fixed handle, a movable handle and a top connector having a penetrating hole allowing the glue gun ejector rod to pass therethrough; an upper end of the fixed handle is fixedly connected with a lower end of the top connector; an upper end of the movable handle is pivotally connected with the interior of the top connector, and the movable handle is at a front side of the fixed handle; and the glue gun handle further comprises the above-described glue-saving mechanism; wherein a top end of the top connector is provided with a groove extending in the horizontal direction and having a rear end penetrating the top connector; the body is mounted inside the groove so as to be slidable forward and backward relative to the top connector, and the rear end of the body protrudes from the groove; and the locking piece is on the rear side of the top connector.

The glue gun handle provided in the embodiment of the present disclosure has all the advantageous effects that the above-described glue-saving mechanism can achieve.

An embodiment of the present disclosure provides a glue gun, comprising a gun body and the above-described glue gun handle; wherein the gun body comprises a front connector, a middle connector and a rear connector which are sequentially connected; the front connector and the rear connector are both cylindrical, a top, a front end and a rear end of the front connector are open, a front end of the rear connector is open, and a rear end of the rear connector is connected with the front end of the glue gun handle; and the front connector and the rear connector are both made of plastic, and the middle connector is made of metal.

In the glue gun provided in the embodiment of the present disclosure, with both the front connector and the rear connector being made of plastic and the middle connector being made of metal, the advantageous effects of higher strength, lower deformability, and longer service life are achieved as compared with the gun body completely made of plastic in the prior art; and the advantageous effect of lighter structure is achieved as compared with the gun body completely made of metal in the prior art.

BRIEF DESCRIPTION OF DRAWINGS

In order to more clearly illustrate the technical solutions of the specific embodiments of the present disclosure or in the prior art, brief description is made below on the drawings required to be used in the description of the specific embodiments or the prior art. Apparently, the drawings in the following description illustrate some of the embodiments of the present disclosure, and for a person of ordinary skills in the art, other drawings may be obtained in light of these drawings without inventive effort.

FIG. 9 is a schematic view of an overall structure of a glue gun provided in an embodiment of the present disclosure, wherein the angle A between a front surface of the locking piece and the horizontal direction is greater than 0° and smaller than 90°; and FIG. 10 is a sectional view of the overall structure of a glue gun handle provided in an embodiment of the present disclosure.

Figure 1:
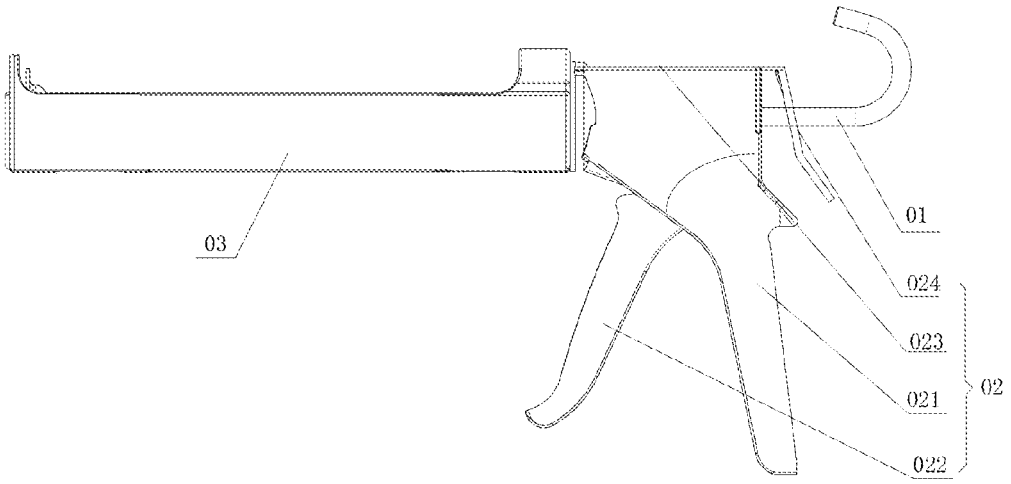
FIG. 1 Prior Art
FIG. 1 is a schematic view of an overall structure of a glue gun in the prior art.

Reference signs: 01—glue gun ejector rod; 02—glue gun handle; 021—fixed handle; 022—movable handle; 023—top connector; 0231—penetrating hole; 024—lock tab; 03—gun body; 031—front connector; 032—middle connector; 033—rear connector; 04—driving block; 05—driving spring; 1—glue-saving mechanism; 11—body; 110—guiding seat; 111—long limiting hole; 112—switching limiting hole; 113—mounting hole; 12—locking piece; 121—assembling hole for glue gun ejector rod; 1211—flange; 13—limiting member; 14—locking assembly; 140—connecting lug; 141—elastic energy storage member; 142—mounting shaft; 15—switching button; 151—button body; 1511—connecting portion; 1512—rotating portion; and 152—limiting portion.

DETAILED DESCRIPTION OF EMBODIMENTS

In order to make the objects, technical solutions and advantages of the embodiments of the present disclosure clearer, the technical solutions of the embodiments of the present disclosure will be described clearly and completely below with reference to the drawings of the embodiments of the present disclosure. Apparently, the embodiments described are some of the embodiments of the present disclosure, rather than all of the embodiments. The components of the embodiments of the present disclosure described and illustrated in the drawings herein can generally be arranged and designed in a variety of different configurations.

Thus, the following detailed description of the embodiments of the present disclosure provided in the drawings is not intended to limit the scope of protection of the present disclosure, but is merely representative of the selected embodiments of the present disclosure. All the other embodiments that are obtained by a person of ordinary skills in the art without inventive effort on the basis of the embodiments of the present disclosure shall be covered by the scope of protection of the present disclosure.

It should be noted that like reference signs and letters denote like items in the following drawings, and therefore, once a certain item is defined in one figure, it does not need to be further defined or explained in the following figures.

In the description of the present disclosure, it is to be noted that orientation or position relations denoted by terms such as "upper", "lower", "vertical", "horizontal", "inner" and "outer" are based on the orientation or position relations indicated by the figures, or refers to the orientation or position where the product of the present disclosure is normally placed when in use, which only serves to facilitate describing the present disclosure and simplify the description, rather than indicating or suggesting that the device or element referred to must have a particular orientation, or be constructed and operated in a particular orientation, and therefore cannot be construed as a limitation on the present disclosure.

In addition, terms such as "horizontal" and "vertical" do not necessarily require that the components must be absolutely horizontal or pendulous, rather, they can be slightly inclined. For example, the term "horizontal" merely refers to a more horizontal direction relative to the direction indicated by the term "vertical", and does not necessarily require that the structure must be absolutely horizontal, rather, it can be slightly inclined.

In the description of the present disclosure, it should be further noted that unless otherwise explicitly specified and defined, the terms "arrange", "mount" and "connect" shall be understood in a broad sense, which may, for example, refer to fixed connection, detachable connection or integral connection; may refer to mechanical connection or electrical connection; may refer to direct connection or indirect connection by means of an intermediate medium; and may refer to internal communication between two elements. A person of ordinary skills in the art could understand the specific meaning of the terms in the present disclosure according to specific situations.

Some of the embodiments of the present disclosure are described in detail below with reference to the drawings. The following embodiments and the features in the embodiments can be combined with each other if there is no conflict.

Figure 2:
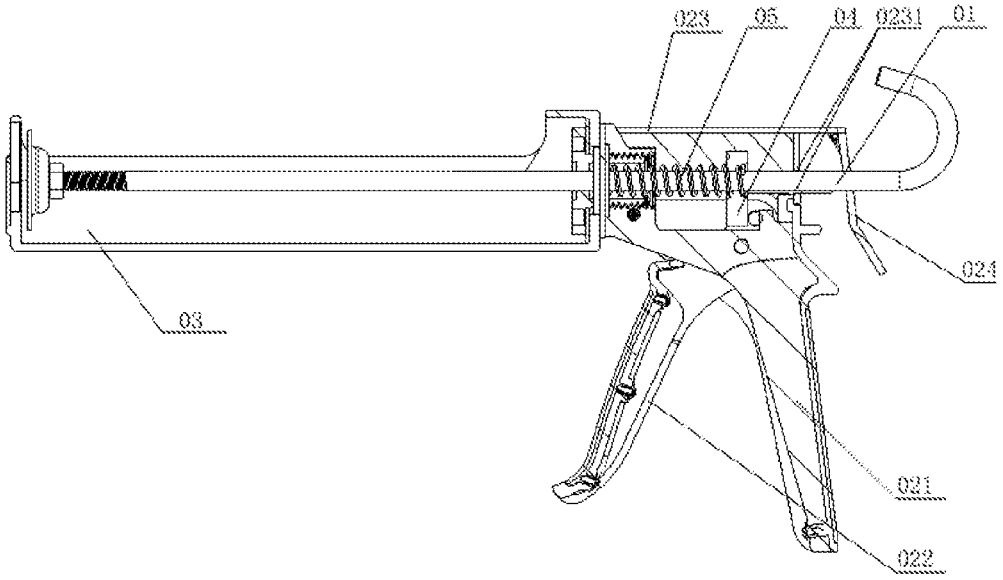
FIG. 2 Prior Art
FIG. 2 is a sectional view of the overall structure of the glue gun in the prior art.

The glue gun is a gluing tool, as shown in FIG. 1 and FIG. 2, the glue gun currently used comprises a glue gun ejector rod 01, a glue gun handle 02, and a gun body 03 connected with the front end of the glue gun handle 02. The glue gun handle 02 comprises a fixed handle 021, a movable handle 022, and a top connector 023 having a penetrating hole 0231 allowing the glue gun ejector rod 01 to pass therethrough; the upper end of the fixed handle 021 is fixedly connected with the lower end of the top connector 023, wherein the fixed handle 021 may be fixedly connected with the lower end of the top connector 023 by screws, rivets or other fixing members, or may be integrally formed with the top connector 023; the upper end of the movable handle 022 is pivotally connected with the interior of the top connector 023, and the movable handle 022 is on the front side of the fixed handle 021; wherein the glue gun handle 02 further comprises a lock tab 024 hinged to the rear end of the top connector 023, the lock tab 024 is provided with a perforation, the glue gun ejector rod 01 passes through the penetrating hole 0231 on the top connector 023 and the perforation on the lock tab 024, and the rear end of the glue gun ejector rod 01 is outside the top connector 023, and the front end of the glue gun ejector rod extends to the interior of the gun body 03; a driving block 04 is slidably disposed on the glue gun ejector rod 01; the driving block 04 is hinged to the upper end of the movable handle 022, or the lower end of the driving block 04 abuts the front side of the upper end of the movable handle 022, a driving spring 05 is further sleeved on the glue gun ejector rod 01, and one end of the driving spring 05 abuts the driving block 04, and the other end of the driving spring abuts the rear end surface of the gun body 03; and a spring is provided between the lock tab 024 and the top connector 023, and the spring inclines the lock tab 024 so that the glue gun ejector rod 01 is locked in the perforation of the lock tab 024.

In specific use, the lock tab 024 is pressed so that the lock tab 024 extends in the vertical direction to release the glue gun ejector rod 01, the glue gun ejector rod 01 is pulled to make the front end of the glue gun ejector rod 01 move backward to release the lock tab 024, the glue cartridge is placed in the interior of the gun body 03 with the glue outlet thereof facing forward, the movable handle 022 is pulled backward, at this time, the upper end of the movable handle 022 can tilt the driving block 04 so that the driving block 04 locks the glue gun ejector rod 01, at the same time, the upper end of the movable handle 022 pushes the driving block 04 to move forward to drive the glue gun ejector rod 01 to move forward against the frictional force between the glue gun ejector rod 01 and the perforation of the lock tab 024, to make the front end of the glue gun ejector rod 01 press the rear end of the glue cartridge placed in the interior of the gun body 03, thereby releasing glue from the glue cartridge; the driving spring 05 is compressed during the advancement of the driving block 04, and the driving spring 05 enable the driving block 04 and the movable handle 022 to always have a movement tendency to restore, so that when the movable handle 022 is released, the driving block 04 returns and gets itself aligned, and in this way, the operations are repeated for applying glue.

In the prior art, when a glue gun stops gluing, since the volume of the glue cartridge is reduced due to being pressed before stopping gluing, at this time, the pressure in the cartridge is greater than the pressure outside the cartridge, and the glue cartridge has a movement tendency of slowly backward releasing its internal pressure, since the glue gun ejector rod 01 is locked in the perforation of the lock tab 024, and the internal pressure of the glue cartridge is insufficient to move the glue gun ejector rod 01 backward against the frictional force between the glue gun ejector rod 01 and the perforation of the lock tab 024, at this time, the glue gun ejector rod 01 is in the state of pressing against the rear end of the glue cartridge and cannot be moved, and the glue in the glue cartridge will partially continue to flow out from the glue outlet of the glue cartridge under the internal pressure of the glue cartridge. Although in some cases such phenomenon that the glue continues flowing out from the glue cartridge after the gluing stops does not affect the use, and this phenomenon even brings certain advantages in the work requiring continuous glue discharge, in some cases, the phenomenon that the glue continues flowing out from the glue cartridge after the gluing stops interferes with the process, and also leads to a serious problem of glue waste.

In view of the above, the present embodiment provides a glue-saving mechanism 1. Specifically, referring to FIG. 3, FIGS. 4 and 5, the glue-saving mechanism 1 comprises a body 11 and a locking piece 12; wherein a top end of the locking piece 12 is connected with a rear end of the body 11, the locking piece 12 is provided with a assembling hole 121 for glue gun ejector rod penetrating the locking piece 12, and the angle between a front surface of the locking piece 12 and the horizontal direction is greater than 0° and smaller than 90° when a length extension direction of a glue gun ejector rod in a working condition that the glue gun ejector rod is assembled to the glue gun is regarded as a horizontal direction, for example, the angle between the front surface of the locking piece 12 and the horizontal direction is 45°, 65°, 85° or the like; and a guiding structure is provided on the body 11, and the guiding structure is configured to guide the body 11 to slide forward and backward relative to a glue gun handle in a working condition that the glue-saving mechanism 1 is assembled at a top end of the glue gun handle.

Referring to FIG. 7 to FIG. 10, before use, the glue-saving mechanism 1 is mounted at the top end of the glue gun handle first, and the specific mounting process is as follows: mounting the body 11 at the top end of the glue gun handle so as to be slidable forward and backward along the top of the glue gun handle, positioning the locking piece 12 on the rear side of the top connector 023, and making the rear end of the glue gun ejector rod 01 pass through the penetrating hole 0231 in the top connector 023 and then continue to pass through the assembling hole 121 for glue gun ejector rod on the locking piece 12, wherein at this time, since the angle between the front surface of the locking piece 12 and the horizontal direction is greater than 0° and smaller than 90°, the locking piece 12 is inclined relative to the vertical direction, and the hole wall of the assembling hole 121 for glue gun ejector rod is inclined, then the glue gun ejector rod 01 is locked in the assembling hole 121 for glue gun ejector rod.

At the time of operating the glue gun to release glue, the movable handle 022 is pulled, since the glue gun ejector rod 01 is locked in the assembling hole 121 for glue gun ejector rod, the top end of the locking piece 12 is connected with the rear end of the body 11, and the body 11 can slide forward and backward along the top of the glue gun handle, each time the movable handle 022 is pulled, the glue gun ejector rod 01 and the body 11 synchronously move forward for a certain distance, until the locking piece 12 is stuck on the rear end surface of the top connector 023, or until being blocked on the rear end surface of the top connector 023 by other blocking portions provided on the body 11 or on the rear end surface of the top connector 023 that can block the body 11 from continuing to moving forward, and in such case, the body 11 immediately stops moving forward, and at this time, the glue gun ejector rod 01 continues to move forward for a certain distance alone under the action of the movable handle 022 and the driving block 04, to press the glue cartridge mounted inside the gun body 03 of the glue gun, so as to make the glue cartridge release glue.

At the time of stopping pulling the movable handle 022, since the volume of the glue cartridge is reduced due to being pressed before stopping pulling the movable handle, the pressure in the cartridge is greater than the pressure outside the cartridge, and the glue cartridge has a movement tendency of slowly backward releasing the internal pressure, since the body 11 can slide forward and backward along the top of the glue gun handle, the body 11 can drive the glue gun ejector rod 01 to move backward for a certain distance, at this time, the distance by which the body 11 drives the glue gun ejector rod 01 to move backward is equal to the previous distance by which the glue gun ejector rod 01 and the body 11 synchronously move forward, so that the internal pressure of the glue cartridge is released slowly, which further reduces or even avoids the case where the glue in the glue cartridge continues to flow out from the glue outlet of the glue cartridge under the action of the internal pressure of the glue cartridge, so as to save glue and also reduce or even avoid continuous glue outflow, which interferes with the effect of the process.

Figure 3:
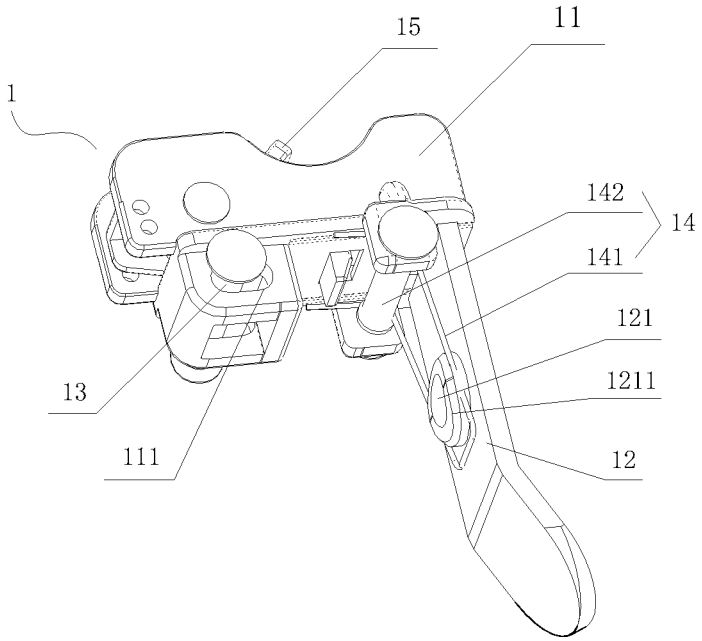
FIG. 3 is a schematic view of an overall structure of a glue-saving mechanism provided in an embodiment of the present disclosure.
Figure 4:
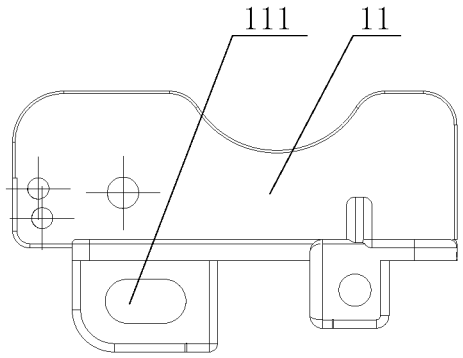
FIG. 4 is a schematic view of an overall structure of a body of a glue-saving mechanism provided in an embodiment of the present disclosure, viewed at an angle.
Figure 5:
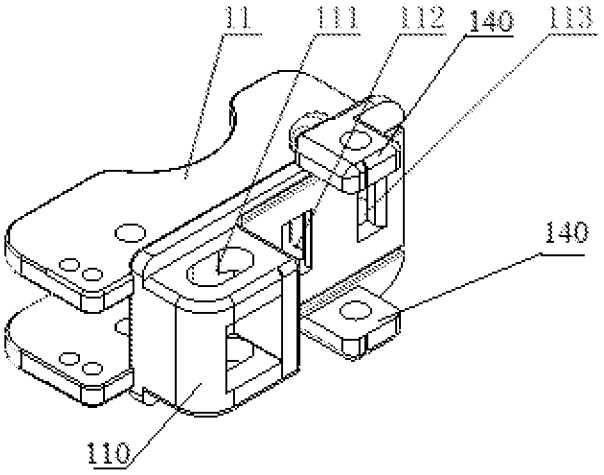
FIG. 5 is a schematic view of an overall structure of the body of the glue-saving mechanism provided in an embodiment of the present disclosure, viewed at another angle.

Referring to FIG. 3, FIG. 4 and FIG. 5, in an optional implementation mode of the present embodiment, the top end of the locking piece 12 is movably connected with the rear end of the body 11, and a locking assembly 14 is mounted between the body 11 and the locking piece 12; wherein the locking assembly 14 is configured such that the angle between the front surface of the locking piece 12 and the horizontal direction is greater than 0° and smaller than 90°. There are a variety of ways in which the top end of the locking piece 12 is movably connected with the rear end of the body 11, for example, as shown in FIG. 5, a mounting hole 113 is provided on the bottom surface of the rear end of the body 11, and the locking piece 12 is movably connected with the body 11 with its top end passing through the mounting hole 113, or the locking piece 12 is hinged to the rear end of the body 11 by a hinge shaft, etc.

Referring to FIG. 3, in the above-described optional implementation mode, optionally, the locking assembly 14 may comprise an elastic energy storage member 141; and one end of the elastic energy storage member 141 is fixed to the body 11, and the other end of the elastic energy storage member 141 abuts the locking piece 12 and is configured so that the locking piece 12 always has a movement tendency enabling the angle between the front surface thereof and the horizontal direction to be greater than 0° and smaller than 90°. Optionally, the locking assembly 14 may further comprise a mounting shaft 142, wherein the mounting shaft 142 is fixed to the bottom of the body 11; and the elastic energy storage member 141 comprises a U-shaped spring, both ends of the U-shaped spring keep away from the mounting shaft 142 and abut the bottom surface of the body 11, and a U-shaped end of the U-shaped spring abuts the locking piece 12.

Optionally, referring to FIG. 3 to FIG. 5, connecting lugs 140 may be provided at the bottom end of the body 11, the number of the connecting lugs 140 is two, wherein the two connecting lugs 140 are provided at the left and right edges of the bottom of the body 11, respectively, and each of the left and right ends of the mounting shaft 142 are connected with one of the two connecting lugs 140, respectively. Specifically, each connecting lug 140 may be provided with a through hole, the mounting shaft 142 sequentially passes through the through holes of the two connecting lugs 140, and the end portion of the mounting shaft 140 is riveted to the outer side of the through hole.

Evidently, in other optional implementation modes of the present embodiment, the locking piece 12 may be fixedly connected with the rear end of the body 11, wherein the locking piece 12 is made of an elastic piece, its own elastic force makes the locking piece 12 always have a movement tendency making the angle between the front surface thereof and the horizontal direction to be greater than 0° and smaller than 90°, and the above-mentioned locking assembly 14 is not provided, thereby realizing the locking piece's locking or non-locking function for the glue gun ejector rod 01. Optionally, the top end of the locking piece 12 is movably connected with the rear end of the body 11, and a locking assembly 14 is mounted between the body 11 and the locking piece 12, but the locking assembly 14 is a structure in which the angle between the front surface of the locking piece 12 and the horizontal direction needs to be manually adjusted and fixed, such as a fixing pin. Optionally, the top end of the locking piece 12 is movably connected with the rear end of the body 11, a locking assembly 14 is mounted between the body 11 and the locking piece 12, wherein the locking assembly 14 comprises an elastic energy storage member 141, but the elastic energy storage member 141 is not a U-shaped spring, but a common torsion spring, magnetic attraction structure, or the like, and the above-mentioned mounting shaft 142 may not be provided, instead, a fixing hole is provided at the bottom of the body 11, so that the end portion of the elastic energy storage member 141 is fixed in the fixing hole, other methods are also feasible as long as the locking effect can be achieved.

Continuing to refer to FIG. 3, in the above-described optional implementation modes, optionally, one side of the assembling hole 121 for glue gun ejector rod facing the U-shaped spring is flanged to form a flange 1211, wherein the U-shaped end of the U-shaped spring is sleeved outside the flange 1211. In this way, by forming the assembling hole 121 for glue gun ejector rod into a structure formed by punching a hole first and then flanging, a bright zone is enlarged, and even the effect of full bright zone is achieved, which further increases the frictional force between the glue gun ejector rod 01 and the assembling hole 121 for glue gun ejector rod and increases the clamping force by the locking piece 12 on the glue gun ejector rod 01. Moreover, the U-shaped end of the U-shaped spring is limited by the flange 1211, so as to ensure that the angle between the front surface of the locking piece 12 and the horizontal plane is greater than 0° and smaller than 90°.

Evidently, in other optional implementation modes of the present embodiment, the above-described flange 1211 may not be provided, and the above-described assembling hole 121 for glue gun ejector rod is a common punched hole structure, which can also accomplish the function of locking the glue gun ejector rod 01 described above. However, by comparison, it is a better choice that the assembling hole 121 for glue gun ejector rod is configured by selecting the structures described in the above-described optional implementation modes.

In addition, referring to FIG. 3, in one optional implementation mode of the present embodiment, the guiding structure comprises a long limiting hole 111; and the long limiting hole 111 penetrates a side wall of the body 11, and a center line of the long limiting hole 111 extends in the horizontal direction; and the glue-saving mechanism 1 further comprises a limiting member 13, the limiting member 13 is slidably disposed inside the long limiting hole 111, and an end portion of the limiting member 13 passes through the long limiting hole 111 to be fixed to the top end of the glue gun handle, and there are a variety of ways for fixing the limiting member, e.g., welding, connecting by screws, or connecting by injection molding. Here, the limiting member 13 and the long limiting hole 111 are movable relative to each other to guide the body 11 to slide forward and backward relative to the top connector 023, and the limiting member 13 may be a rivet, a pin shaft, or the like. Evidently, the guiding structure may also be a structure in which a slide rail and a projection are engaged with each other, etc., as long as the guiding function can be realized.

Optionally, referring to FIG. 3 to FIG. 5, a guiding seat 110 may be provided at the bottom end of the body 11, wherein the guiding seat 110 is an internally hollow structure, two long limiting holes 111 are provided, the two long limiting holes 111 are respectively provided on the side plates on the left and right sides of the guiding seat 110, and the two long limiting holes 111 correspond to each other in position and shape. The limiting member 13 passes through the two long limiting holes 111 and both ends of the limiting member 13 are led out from the respective long limiting holes 111 to be connected with the glue gun handle. In use, the limiting member 13 is fixed to the top end of the glue gun handle and keeps a stationary state, and the long limiting holes 111 can move forward and backward relative to the glue gun handle under the guiding action of the limiting member 13. In addition, the length of the long limiting holes 111 is the stroke of the body moving forward and backward, and when the front and rear ends of the long limiting holes 111 abut the limiting member 13, the body 11 correspondingly reaches the frontmost end and the rearmost end of the stroke.

Referring to FIG. 3 to FIG. 6, in combination with FIG. 7 to FIG. 10, in the above-described optional implementation mode, optionally, the glue-saving mechanism further comprises a switching button 15. Specifically, the bottom surface of the body 11 is provided with a switching limiting hole 112; the switching button 15 comprises a button body 151 and a limiting portion 152 connected with each other, wherein the button body 151 is pivotally connected with the body 11 and is configured to drive the limiting portion 152 into or away from the switching limiting hole 112; and in the working condition that the glue-saving mechanism 1 is assembled to the top end of the glue gun handle and the limiting portion 152 is in the switching limiting hole 112, the limiting portion 152 abuts a rear end surface of the glue gun handle, and the limiting member 13 is positioned at the frontmost ends of the long limiting holes 111.

In this optional implementation mode, the glue-saving mechanism is specifically used under two working conditions:

in a first working condition, the button body 151 is pulled to move the limiting portion 152 away from the switching limiting hole 112, in this case, the glue-saving mechanism 1 has the glue-saving function and is suitable for a process in which glue flows out discontinuously, and the working principle of the glue-saving mechanism is the same as the aforementioned working principle of operating the glue gun to release glue; and preferably, when mounting the body 11, in the initial working position, the limiting member 13 is positioned at the frontmost ends of the long limiting holes 111; and in a second working condition, the button body 151 is pulled to drive the limiting portion 152 into the switching limiting hole 112, in this case, the glue-saving mechanism 1 does not have the glue-saving function and is suitable for a process requiring continuous glue outflow, referring to FIG. 3 to FIG. 10, the working principle of the glue-saving mechanism is as follows:

at the time of operating the glue gun to release glue, the movable handle 022 is pulled, since the glue gun ejector rod 01 is locked in the assembling hole 121 for glue gun ejector rod, and the top end of the locking piece 12 is connected with the rear end of the body 11, each time the movable handle 022 is pulled, the glue gun ejector rod 01 moves forward for a certain distance to press the glue cartridge mounted inside the gun body 03 of the glue gun, so as to make the glue cartridge release glue; since the limiting portion 152 is positioned in the switching limiting hole 112 and the limiting portion 152 abuts the rear end surface of the top connector 023, the limiting member 13 cannot move relative to the long limiting hole 111, and at this time, the body 11 cannot move forward along with the glue gun ejector rod 01; and at the time of stopping pulling the movable handle 022, since the volume of the glue cartridge is reduced due to being pressed before stopping pulling the movable handle, at this time, the pressure in the cartridge is greater than the pressure outside the cartridge, and the glue cartridge has a movement tendency of slowly backward releasing the internal pressure, at this time, since the limiting member 13 is positioned at the frontmost ends of the long limiting holes 111, the limiting member 13 cannot move relative to the long limiting holes 111, that is, the body 11 cannot move backward, the glue gun ejector rod 01 maintains the position of performing gluing, so that the glue in the glue cartridge will partially continue to flow out from the glue outlet of the glue cartridge under the action of the internal pressure of the glue cartridge, so as to release the internal pressure of the glue cartridge.

In the above-described optional implementation mode of the present embodiment, by providing the switching button 15, in addition to the glue-saving function, the glue-saving mechanism is enabled to have the capability of switching between the two working modes, i.e., the glue-saving mode and the non-glue-saving mode, so as to be selectively used by the operator according to the specific work requirements, which has the advantageous effects of being convenient to operate and widely applicable, and has the advantage of low manufacture cost as compared with the case of producing the glue guns with different functions separately to meet the requirements of production activities.

Figure 6:
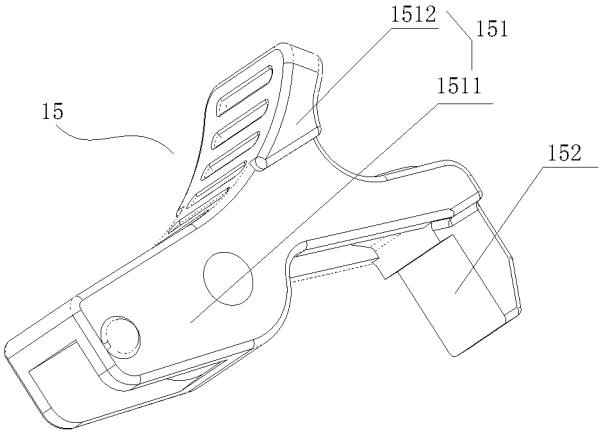
FIG. 6 is a schematic view of an overall structure of a switching button of a glue-saving mechanism provided in an embodiment of the present disclosure.

Referring to FIG. 6, in the above-described optional implementation mode of the present embodiment, optionally, the button body 151 may comprise a connecting portion 1511 and a rotating portion 1512; wherein one end of the connecting portion 1511 is pivotally connected with the body 11; one end of the rotating portion 1512 is connected with the top of the connecting portion 1511, and the other end of the rotating portion 1512 extends obliquely upward; and one end of the limiting portion 152 is connected with the other end of the connecting portion 1511, and the other end of the limiting portion 152 extends downward. Therefore, once the rotating portion 1512 is pulled, the limiting portion 152 is controlled to enter or move away from the switching limiting hole 112, which has the advantageous effect of simple operation. There are multiple ways in which the rotating portion 1512 and the limiting portion 152 are respectively connected with the connecting portion 1511, for example, integral connection, connection by a fixing member such as a screw or a rivet, or the like.

Figure 7:
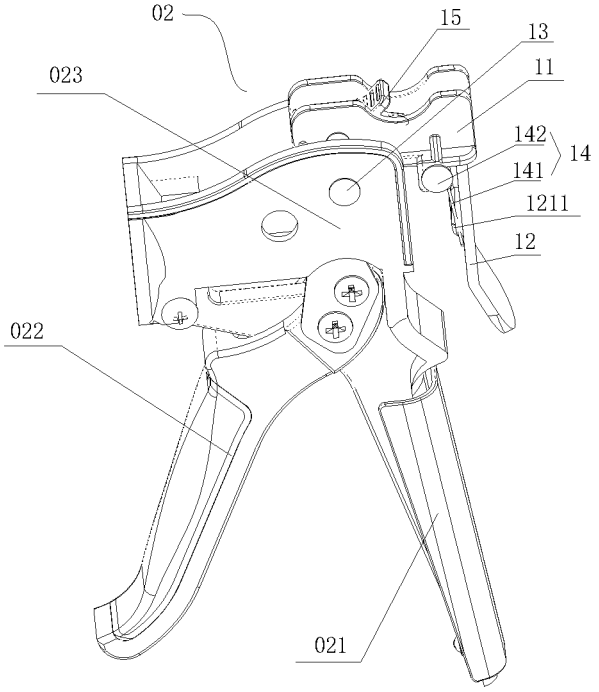
FIG. 7 is a schematic view of an overall structure of a glue gun handle provided in an embodiment of the present disclosure.
Figure 8:
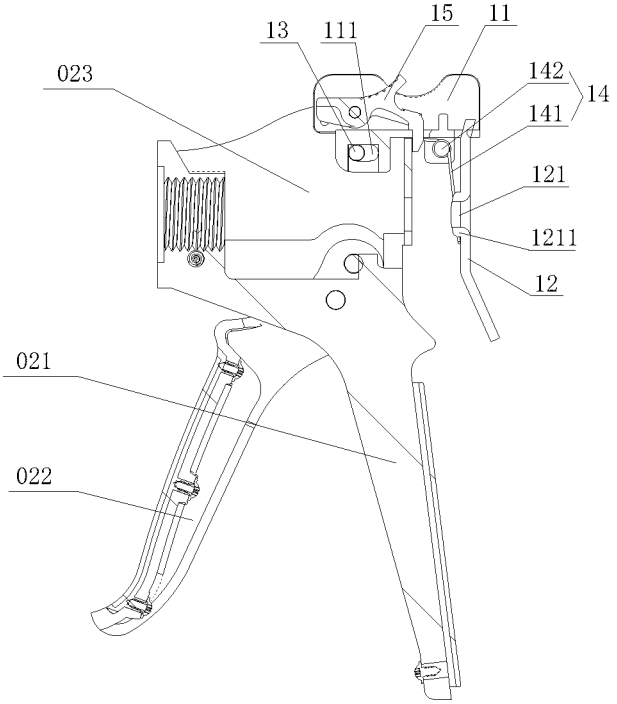
FIG. 8 is a sectional view of an overall structure of a glue gun handle provided in an embodiment of the present disclosure.
Figure 11:
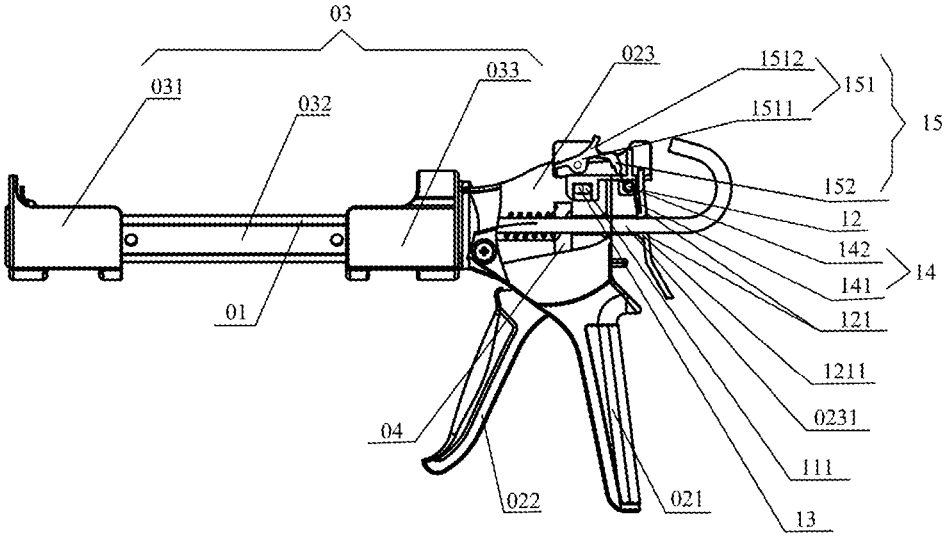
FIG. 11 is the overall structure of a glue gun handle provided in an embodiment of the present disclosure, in a first working condition, wherein the button body 151 is pulled to move the limiting portion 152 away from the switching limiting hole.

Referring to FIG. 7 and FIG. 8, in combination with FIG. 9 and FIG. 10, the present embodiment provides a glue gun handle 02, with the glue gun handle 02 comprising a fixed handle 021, a movable handle 022 and a top connector 023, wherein the top connector 023 has a penetrating hole 0231 configured to allow the glue gun ejector rod 01 to pass therethrough; an upper end of the fixed handle 021 is fixedly connected with a lower end of the top connector 023; an upper end of the movable handle 022 is pivotally connected with the interior of the top connector 023, and the movable handle 022 is at a front side of the fixed handle 021.

In the above, the glue gun handle 02 further comprises the above-described glue-saving mechanism 1. Optionally, as shown in FIG. 7 and FIG. 8, the top end of the top connector 023 is provided with a groove extending in the horizontal direction and having a rear end penetrating the top connector 023; the body 11 is mounted inside the groove so as to be slidable forward and backward relative to the top connector 023, and the rear end of the body 11 protrudes out from the groove; and the end portions of the limiting member 13 passing through the respective long limiting holes 111 is fixed to the top connector 023, and the locking piece 12 is on the rear side of the top connector 023.

In particular, in an optional implementation mode in which the glue gun handle 02 comprises a switching button 15, the switching button 15 is assembled such that both ends of the limiting member 13 are fixedly connected with both side walls of the groove, respectively, and in the working condition that the limiting portion 152 is disengaged from the switching limiting hole 112, the body 11 can slide in the front-rear direction of the groove under the limiting action of the limiting member 13; and in the working condition that the limiting portion 152 is in the switching limiting hole 112, the limiting portion 152 abuts the rear end surface of the top connector 023, and the limiting member 13 is at the frontmost ends of the long limiting holes 111, the front and rear parts of the body 11 are in a fixed state under the joint action of the limiting member 13 and the top connector 023 and cannot move relative to the groove, accordingly, there is no glue-saving function, and the glue gun can continuously release glue.

The working principle of the glue gun handle 02 is the same as that of the aforementioned glue-saving mechanism 1, which will not be described repeatedly here.

Referring to FIG. 9 and FIG. 10, the present embodiment provides a glue gun, comprising a gun body 03 and the above-described glue gun handle 02; wherein the gun body 03 comprises a front connector 031, a middle connector 032 and a rear connector 033 which are sequentially connected; the front connector 031 and the rear connector 033 are both cylindrical, a top, a front end and a rear end of the front connector 031 are open, a front end of the rear connector 033 is open, and a rear end of the rear connector 033 is connected with the front end of the glue gun handle 02; and the front connector 031 and the rear connector 033 are both made of plastic, and the middle connector 032 is made of metal. Optionally, the rear end of the rear connector is also provided to be open or is provided with a through hole allowing the glue gun ejector rod to pass therethrough; the front connector 031, the middle connector 032 and the rear connector 033 are sequentially connected with form a cylindrical gun body with an opening facing upward, the glue cartridge is accommodated in the cylindrical gun body, and a front opening of the glue cartridge protrudes from the front opening of the front connector 031; and the front end of the glue gun ejector rod extends into the gun body through the through hole or a rear opening of the rear connector 033 to abut the rear end of the glue cartridge, and is configured to press the rear end of the glue cartridge to release glue from the front end of the glue cartridge.

In the above, the front connector 031 and the rear connector 033 may be separately welded or directly injection molded to the middle connector 032, the middle connector 032 is optionally made of a lightweight aluminum material, and the outer side of the middle connector 032 may be coated with an oxidation-resistant coating. In addition, in order to further reduce the mass of the middle connector, a hollowed-out region or the like may be provided on the middle connector 032.

In the glue gun provided in the present embodiment, with both the front connector 031 and the rear connector 033 being made of plastic and the middle connector 032 being made of metal, the advantageous effects of higher strength, lower deformability, and longer service life are achieved as compared with the gun body 03 completely made of plastic in the prior art; and the advantageous effect of lighter structure is achieved as compared with the gun body completely made of metal in the prior art.

The present embodiment further provides a use method using the above-described glue gun, comprising use steps of: placing the glue cartridge into the gun body 03 with the glue outlet facing forwards; passing the glue gun ejector rod 01 sequentially through the mounting hole 0231 and the assembling hole 121 for glue gun ejector rod, with the front end of the glue gun ejector rod abutting the glue cartridge; and pulling the movable handle 022 to make the glue gun ejector rod 01 and the glue-saving mechanism synchronously move forward along the groove until the locking piece is stuck on the rear end surface of the top connector 023; and continuing to pull the movable handle 022, with the glue-saving mechanism being kept stationary, and the glue gun ejector rod 01 pressing the glue cartridge forward to make the glue cartridge release glue.

In the above, when glue flows out discontinuously in a process, after the glue cartridge and the glue gun ejector rod 01 are mounted, the button body 151 may be pulled to separate the limiting portion 152 from the switching limiting holes 112; and after glue flows out from the glue cartridge, the internal pressure of the glue cartridge drives the glue gun ejector rod 01 and the glue-saving mechanism to move backwards along the groove, and the internal pressure of the glue cartridge decreases.

In the above, when glue flows out continuously in a process, after the glue cartridge and the glue gun ejector rod 01 are mounted, the button body 151 is pulled to make the limiting portion 152 enter the switching limiting hole 112; and after the glue flows out from the glue cartridge, the glue-saving mechanism is limited by the limiting portion 152 and the limiting member 13 and keeps stationary, and the glue in the glue cartridge flows out from the glue outlet under the action of the internal pressure of the glue cartridge.

Finally, it should be noted that the above embodiments are only used to illustrate the technical solutions of the present disclosure, rather than limit the same; although the present disclosure has been described in detail with reference to the foregoing embodiments, it should be understood by those of ordinary skills in the art that the technical solutions described in the embodiments can still be modified, or equivalent substitution can be made to some or all of the technical features therein; and the modification or substitution would not cause the essence of the corresponding technical solutions to depart from the scope of the technical solutions of the embodiments of the present disclosure.

INDUSTRIAL APPLICABILITY

In the glue-saving mechanism, the glue gun handle, the glue gun and the use method thereof provided in the embodiments of the present disclosure, after the completion of glue release from the glue cartridge, the glue gun ejector rod can return under the action of the internal pressure of the glue cartridge to slowly release the pressure inside the glue cartridge, thereby reducing and even avoiding continuous outflow of glue, which achieves the glue-saving effect and reduces the interference of continuous glue outflow with the process.

The invention claimed is:

1. A glue-saving mechanism, which is applicable to a glue gun, wherein the glue-saving mechanism comprises a body and a locking piece; a top end of the locking piece is connected with a rear end of the body, the locking piece is provided with an assembling hole for a glue gun ejector rod, with the assembling hole penetrating the locking piece, and, an angle between a front surface of the locking piece and the horizontal direction is greater than 0° and smaller than 90° when a length extension direction of the glue gun ejector rod in a working condition that the glue gun ejector rod is assembled to the glue gun is regarded as a horizontal direction, an angle between a front surface of the locking piece and the horizontal direction is greater than 0° and smaller than 90°;

a guiding structure is provided on the body, wherein the guiding structure is configured to guide the body to slide forward and backward relative to a glue gun handle in the working condition that the glue-saving mechanism is assembled to a top end of the glue gun handle; and the top end of the locking piece is movably connected with the rear end of the body, and a locking assembly is mounted between the body and the locking piece; and the locking assembly is configured so that the angle between the front surface of the locking piece and the horizontal direction is greater than 0° and smaller than 90°.

2. The glue-saving mechanism according to claim 1, wherein a bottom surface of the rear end of the body is provided with a mounting hole, and the top end of the locking piece is movably inserted into the mounting hole.

3. The glue-saving mechanism according to claim 2, wherein the locking assembly comprises an elastic energy storage member; and one end of the elastic energy storage member is fixed to the body, and the other end of the elastic energy storage member abuts the locking piece and is configured so that the locking piece always has a movement tendency enabling the angle between the front surface of the locking piece and the horizontal direction to be greater than 0° and smaller than 90°.

4. The glue-saving mechanism according to claim 2, wherein the guiding structure comprises a long limiting hole; and the long limiting hole penetrates a side wall of the body, and a center line of the long limiting hole extends in the horizontal direction; and the glue-saving mechanism further comprises a limiting member, the limiting member is slidably disposed inside the long limiting hole, and an end portion of the limiting member passes through the long limiting hole to be fixed to the top end of the glue gun handle.

5. The glue-saving mechanism according to claim 1, wherein the locking assembly comprises an elastic energy storage member; and one end of the elastic energy storage member is fixed to the body, and the other end of the elastic energy storage member abuts the locking piece and is configured so that the locking piece always has a movement tendency enabling the angle between the front surface of the locking piece and the horizontal direction to be greater than 0° and smaller than 90°.

6. The glue-saving mechanism according to claim 5, wherein the locking assembly further comprises a mounting shaft, the mounting shaft is fixed to a bottom of the body; and the elastic energy storage member comprises a U-shaped spring, both ends of the U-shaped spring keep away from the mounting shaft and abut a bottom surface of the body, and a U-shaped end of the U-shaped spring abuts the locking piece.

7. The glue-saving mechanism according to claim 6, wherein one side of the assembling hole for the glue gun ejector rod facing the U-shaped spring is flanged to form a flange, and the U-shaped end of the U-shaped spring is sleeved outside the flange.

8. The glue-saving mechanism according to claim 5, wherein the elastic energy storage member comprises a torsion spring, the bottom of the body is provided with a fixing hole, one end of the torsion spring is fixed in the fixing hole, and the other end of the torsion spring abuts the locking piece.

9. The glue-saving mechanism according to claim 5, wherein the guiding structure comprises a long limiting hole; and the long limiting hole penetrates a side wall of the body, and a center line of the long limiting hole extends in the horizontal direction; and the glue-saving mechanism further comprises a limiting member, the limiting member is slidably disposed inside the long limiting hole, and an end portion of the limiting member passes through the long limiting hole to be fixed to the top end of the glue gun handle.

10. The glue-saving mechanism according to claim 1, wherein the guiding structure comprises a long limiting hole; and the long limiting hole penetrates a side wall of the body, and a center line of the long limiting hole extends in the horizontal direction; and the glue-saving mechanism further comprises a limiting member, the limiting member is slidably disposed inside the long limiting hole, and an end portion of the limiting member passes through the long limiting hole to be fixed to the top end of the glue gun handle.

11. The glue-saving mechanism according to claim 10, wherein the glue-saving mechanism further comprises a switching button;

the bottom surface of the body is provided with a switching limiting hole;

the switching button comprises a button body and a limiting portion connected with each other, wherein the button body is pivotally connected with the body and is configured to drive the limiting portion into or away from the switching limiting hole; and in the working condition that the glue-saving mechanism is assembled to the top end of the glue gun handle and the limiting portion is in the switching limiting hole, the limiting portion abuts a rear end surface of the glue gun handle, and the limiting member is positioned at a frontmost end of the long limiting hole.

12. The glue-saving mechanism according to claim 11, wherein the button body comprises a connecting portion and a rotating portion; and one end of the connecting portion is pivotally connected with the body; one end of the rotating portion is connected with the top of the connecting portion, and the other end of the rotating portion extends obliquely upward; and one end of the limiting portion is connected with the other end of the connecting portion, and the other end of the limiting portion extends downward.

13. The glue-saving mechanism according to claim 1, wherein the guiding structure comprises a long limiting hole; and the long limiting hole penetrates a side wall of the body, and a center line of the long limiting hole extends in the horizontal direction; and the glue-saving mechanism further comprises a limiting member, the limiting member is slidably disposed inside the long limiting hole, and an end portion of the limiting member passes through the long limiting hole to be fixed to the top end of the glue gun handle.

14. A glue gun handle assembly, comprising a fixed handle, a movable handle and a top connector, wherein the top connector is provided with a penetrating hole configured to allow the glue gun ejector rod to pass therethrough; an upper end of the fixed handle is fixedly connected with a lower end of the top connector; an upper end of the movable handle is pivotally connected with an interior of the top connector, and the movable handle is at a front side of the fixed handle;

wherein the glue gun handle assembly further comprises the glue-saving mechanism according to claim 1;

a top end of the top connector is provided with a groove extending in the horizontal direction and having a rear end penetrating the top connector; the body is mounted inside the groove so as to be slidable forward and backward relative to the top connector, and the rear end of the body protrudes from the groove; and the locking piece is at a rear side of the top connector.

15. A glue gun, comprising a gun body and the glue gun handle assembly according to claim 14, wherein the gun body comprises a front connector, a middle connector and a rear connector which are sequentially connected;

the front connector and the rear connector are both cylindrical, a top, a front end and a rear end of the front connector are open, a front end of the rear connector is open, and a rear end of the rear connector is connected with a front end of the glue gun handle assembly; and the front connector and the rear connector are both made of plastic, and the middle connector is made of metal.

16. The glue gun according to claim 15, wherein the middle connector is made of an aluminum material and an outer side of the middle connector is coated with an oxidation-resistant coating.

17. The glue gun according to claim 15, wherein the glue gun is in use:

a glue cartridge is placed into the gun body with a glue outlet facing forwards;

the glue gun ejector rod is passed sequentially through the mounting hole and the assembling hole for glue gun ejector rod, with the front end of the glue gun ejector rod abutting the glue cartridge; and the movable handle is pulled to make the glue gun ejector rod and the glue-saving mechanism synchronously move forward along the groove until the locking piece is stuck on the rear end surface of the top connector; and the movable handle is pulled again, the glue-saving mechanism is kept fixed, and the glue cartridge is pressed forward by the glue gun ejector rod to make the glue cartridge release glue.

18. The glue gun according to claim 17, wherein when the glue gun is used in a process in which glue flows out discontinuously, after the glue cartridge and the glue gun ejector rod are mounted, the button body is pulled to separate the limiting portion from the switching limiting hole; and after glue flows out from the glue cartridge, an internal pressure of the glue cartridge drives the glue gun ejector rod and the glue-saving mechanism to move backwards along the groove, which makes the internal pressure of the glue cartridge decrease.

19. The glue gun according to claim 17, wherein when the flue gun is used in a process in which glue flows out continuously, after the glue cartridge and the glue gun ejector rod are mounted, the button body is pulled to make the limiting portion enter the switching limiting hole; and after glue flows out from the glue cartridge, the glue-saving mechanism is limited and kept stationary by the limiting portion and the limiting member, and glue in the glue cartridge flows out from the glue outlet under an internal pressure of the glue cartridge.

* * * * *